United States Patent [19]

Brändel

[11] 4,186,505

[45] Feb. 5, 1980

[54] TAB-STRIP FOR FILING SYSTEMS

[75] Inventor: Kurt Brändel, Berlin, Fed. Rep. of Germany

[73] Assignee: Standard Sichtgerate GmbH, Fed. Rep. of Germany

[21] Appl. No.: 897,153

[22] Filed: Apr. 17, 1978

[30] Foreign Application Priority Data

Apr. 15, 1977 [DE] Fed. Rep. of Germany ..... 2716746

[51] Int. Cl.[2] ..... B42F 21/04

[52] U.S. Cl. ..... 40/360

[58] Field of Search ..... 40/16, 359, 360; 283/6, 283/7, 18, 21, 36, 37, 65; 402/3

[56] References Cited

U.S. PATENT DOCUMENTS

| | | | |
|---|---|---|---|
| 1,218,558 | 3/1917 | Hub | 40/360 |
| 2,122,223 | 6/1938 | Von Dollen | 40/360 |
| 2,356,332 | 8/1944 | Malmer | 40/16 |
| 2,759,479 | 8/1956 | Gunn et al. | 40/360 |
| 2,795,205 | 6/1957 | Wells | 40/360 |
| 2,895,448 | 7/1959 | Haines | 40/360 |
| 3,263,688 | 8/1966 | Anders | 40/359 |

FOREIGN PATENT DOCUMENTS

| | | | |
|---|---|---|---|
| 247283 | 5/1966 | Austria | 40/360 |
| 1536632 | 1/1970 | Fed. Rep. of Germany | 40/359 |
| 1115239 | 4/1956 | France | 40/360 |

*Primary Examiner*—John McQuade

*Attorney, Agent, or Firm*—Allegretti, Newitt, Witcoff & McAndrews

[57] ABSTRACT

The invention has to do with filing material. A tab-strip has a tab-strip body and a label element on it with guides for receiving a label. The label is able to be moved out of a resting into a labeling position using a handle which can be worked through an opening in the guide from the outside. The label element is formed as a separate element, which is directly held temporarily in the tab-strip body.

22 Claims, 4 Drawing Figures

TAB-STRIP FOR FILING SYSTEMS

BACKGROUND OF THE INVENTION (1) Field to which invention relates

The invention relates to a tab-strip for filing systems with a tab-strip body and a label element fixed to it with guides for receiving a label the latter of which may be put in a resting position and in a view position using a handle acted upon through an opening in the guide from the outside.

(2) The prior art

It has long been normal to make use of markers in filing systems to mark desired parts of the system. Such markers frequently have colors, letters or the like. Such markers are frequently made so that they may be slipped over another part of the system, if they are to be changed. One example of such markers are those which are able to be slipped onto parts of legal files for marking a date which is to be kept, so that once the date has been noted, the marker is put on the right part of the file and, when the date has been kept, is taken off.

However such prior markers only have a limited field of use. Firstly, it is necessary for office workers to have the right marker on hand at all times for marking filing systems. Thus, a great number of different markers must be on hand in an office to reduce the time loss in looking for the right one, and failure to mark the file may occur if the correct marker is not on hand. Furthermore, filing systems or filing material with markers which are able to be removed result in shortcomings when the files are moved from place to place, are being worked upon, etc., because the markers may come off, get in each other's way or be forcefully pulled off.

In order to cure these shortcomings, tab-strips have been designed on whose viewing side an element is placed having a number of pockets, each of which is accessible through a slot on its outside. Signal labels are placed in the pockets which have the same length as the pockets and which, near the slot, have an opening for gripping them. Using the right sort of instrument, a signal label may be gripped using the opening and may be pulled along the slot at least partly out of the pocket. In front of the pocket a transparent, bent-over part of the body of the tab-strip body forms a guide, which receives the pulled out labels acting as an end-stop for them.

To mark the material of the filing system in a certain way, it is only necessary for the right signal label to be pulled or pushed out of the pocket so that it may be readily seen under the transparent part of the tab-strip body. Thus, search for a marker as in prior systems is not necessary, because there are a great number of different sorts of markings which are on hand in the tab-strip itself. Furthermore, the bent-over transparent part of the tab-strip body safeguards the pulled out signal labels against being touched, slipped off, pulled off by force and so on, unlike normal markers of the slip-on sort.

Such prior tab-strip markers also have a number of shortcomings. One shortcoming is that the cost of manufacture of the label unit is high, because hand work is necessary. Furthermore, exact making of the pockets of the label unit with inexpensive apparatus is not possible. And, the signal labels are only guided loosely and may not be in line in the labeling position and, in the worst case, when a stack of filing cards is bumped or jarred which have such prior tab-strip markers, an incorrect signal label may come out of the labeling position into its ready position. Furthermore, all signal labels have the same width so that it is not possible, as for example with slip-on markers, to put the width of a label to use for marking purposes. Lastly, it is necessary for each piece of filing material to have the greatest number of signal labels possibly needed for marking the filing material. This not only results in a higher price for the filing material and markers where a whole number of possible markings is known to be unnecessary beforehand, but furthermore in such prior tab-strips, the label unit frequently obscures areas which otherwise could be used for writing and the like.

Furthermore, having a great number of parts placed near each other for use by an office worker makes it likely that a wrong label will be moved in error. This danger can only be avoided by care in use, if an fact each of the labels is necessary for a certain piece of the marking material. Because, however, this is not frequent, the prior tab-strips make the system more uncertain than is necessary.

SUMMARY OF THE INVENTION

Accordingly, one purpose of the present invention is a tab-strip which is an improvement over the above described prior tab-strips and which overcomes at least some of the above shortcomings.

This purpose is effected by the invention in that the label has the form of a separate label element, which, without being dependent on further separate label elements, may be directly fixed on the tab-strip body and also be removed, and a number of such separate label elements are able to be used as well.

In the invention the maximum number and design needed for a given use may be kept in reserve at a position, for later marking, in the tab-strip. In this respect the separate label element is normally for a certain range of the tab-strip, though because it is designed as a separate element and only fixed for the time being, it is able to be put on the body of the tab-strip differently, and, because it exists as a separate element, it is not only possible for only the number which is in fact required of elements to be placed in the tab-strip body, but for the design to be more easily and better aligned with the guides for the label plate, because it is a separate element.

It is possible for the invention to be used in a particularly great number of different systems, for example, in files in which the cards are overlapping and lie more or less in a single plane. In such files, the tab-strip of the invention is put at the lower edge of the card pockets and the labels are pulled downwardly for marking. Use in vertical files is possible as well, in which the tab-strip is slipped into place at the top viewing edge of the card pockets and the label plates are pulled up. Use in transparent dockets is also possible in which case the label plates of the elements are pulled upwardly for marking.

The tab-strip of the invention is able to be placed on a support part of transparent dockets, which at the lower edge have a groove, in which, from the side, the docket, pocket suspended file card or the like, which has the right fold system for keeping it in place (and best made of a material such as cardboard, plastics, kraft-paper or the like), is pushed into place so as to make a single unit with the support part.

In one form of the invention, the front side of one of the two long edges of the tab-strip body is formed as a guide groove turned towards the tab-strip. On the other of the two long edges, a further guide groove or a stop-edge is formed. The label element is made with a generally four-cornered outline, whose length is made with a loose fit with respect to the distance of the guide grooves from each other or from the stop-edge, and whose diagonal length is greater than this distance. The height of the label element forms a tight fit with the guide groove or grooves. This form of the invention is a tab-strip, whose label elements are able to be moved along the body of the tab-strip by a certain force. However, because of the tight fit, they are kept in the position into which they are pushed. In this respect, the guide groove or grooves results in the necessary pressing force for fixing the label element. Because the label element and the tab-strip body are in agreement with each other, it is possible for the label elements of the invention to be used with especially good effect. This is because an office worker on starting a file is normally conscious of which label plates have to be used at certain positions. It is only necessary to push in the right label elements in the right order into the body of the tab-strip as far as the right position, and they will retain this position because of the gripping fit. The gripping fit is sufficiently great so that normal operations on the file and even a fall or the like of filing material having the tab-strip of the invention, will not result in slipping or falling out of position of the label elements.

A still further feature of the present invention is that the body of the tab-strip may be in the form of a spring at least near the guide groove or grooves. The use of two guide grooves together with such spring-like design, compensates for any variation within tolerances in important dimensions and, on the one hand, results in the pressing force necessary for a gripping fit, and on the other hand, insures that movement of the label element is possible, even in the case of high tolerances and/or dust on the tab-strip. If the play between the label element and the distance between the two grooves is great enough, or if a tab-strip body is used having only one groove and an opposite stop-edge, a surprisingly good effect of the tab-strip of the invention is that it is not necessary to put in the separate label elements in the right order at the end of the body of the tab-strip and, in fact, it is acceptable if the label element is put into position where it is to be used above the stop-edge or one of the two guide grooves and it can be pushed with its end under the opposite guide groove. This is because a guide groove will be so bent up on account of its being made as a spring, that the label element can be pushed in and will then be pressed against the face of the tab-strip body. A good selection of material label elements can be put into position side by side without insertion of the next element causing any trouble, as for example moving the last element inserted out of position, even for a short time.

In order to make possible use of a tab-strip body with only a slight spring effect, a further feature of the invention includes a slip sheet formed between the tab-strip body and the separate element. This slip sheet decreases friction between the tab-strip body and the label element and insures that the element is fixed at all times. Because of the use of the slip-sheet, the selection of material for the parts named is greater and, furthermore, it is possible to make use of the tab-strip of this design in rooms having water or oil vapors in them, as for example in factory areas and the like.

In a further feature of the invention, the slip sheet is a strip of paper or a like material on which writing is possible. It is possible to have markings with good effect for the putting on of the label elements and, more particularly, the spaces still free between the separate label elements of the tab-strip may be used for further lettering.

The label element is best made with a base plate which, on the two sides of the direction of movement of the label plate on its side turned away from the strip body, has grooves which are facing each other for receiving the label plate so that the last-named, which for this purpose has a gripping-fit, is able to be changed in position. The base-plate, which has a four-cornered outline, is for this reason, preferably a cut strip of the right extruded material, which is able to be made with a low tolerance from a great number of materials. The range of selection of materials is made even greater if the label plate is turned to a direction of viewing so it is possible as well to make use of opaque material for the base plate. In this case the base plate extends along the whole distance of movement of the label plate to make certain that the plate is well guided along its whole range of movement. The guide grooves on the two sides of the base plate, furthermore, result in a certain distance at the sides between the label plates at all times, where two label elements are used which are adjacent each other. If the two label plates have some space between them in their labeling position, they will be seen as separate labels or colors which do not seem to be joined together. This prevents one color from being taken for the other, as is the case if there is touching or overlap by two label plates, as may be the case with the prior tab-strips. Furthermore, it is possible to readily observe that one broad label plate is different than two narrow label plates of the same color which are near to each other.

The label plate is guided in a gripping guide, which makes possible its movement using the handle, but on the other hand insures that the position of the label plate is not changed by shaking, undesired touching or the like. In a further form of the invention, two stops may be formed for limiting the movement of the label plate and which give the latter a certain end-position. Thus, it is not necessary to make a selection of the end position when moving the label plate and, in fact, for all label elements the right end position is certain.

In a further form of the invention, the stops are formed by the front and back edges of the label plate and/or the base faces of the guide grooves. Thus, the label plate is readily able to be pushed into the base plate, but slipping out again from the tab-strip body is not possible once it has been inserted. The advantage of this form of the invention is that the person who puts the tab-strips on the filing material only has to put in place the tab-strip body, the base plate and a number of label plates of different colors. If a particular marking is needed on the filing material, it is then only necessary to put the right label plate into any desired base plate and then the separate label element so made is put into the tab-strip body at the necessary position. The cost for storing is for this reason substantially less than in the prior systems, and tab-strips which have once been used are able to be disassembled and reused again.

Because the design is such that the label plate is accessible from the viewing side, the present invention is particularly advantageous in that if the label plate is made of a flexible, springy material, it is possible to remove a label plate after it has been put in with a needle or like instrument without taking the base plate from the tab-strip body. This makes marking at this position impossible in the future. This is particularly advantageous if the need for marking filing material no longer exists and it is desired to make such marking impossible to prevent marking errors. It is, however, possible as well to later insert a flexible label in place of the label which has been taken out. While in prior systems before the present invention, it was necessary for each separate label color to have its own position, it is now possible to have a single position for a number of colors coming one after the other by changing over the label element or changing over only the label plate. The result is that the number of positions which are to be noted on looking at the filing system for checking it, is decreased and, for this reason, visual examination of the files is much more readily and accurately performed.

A particularly good feature of the invention is that the handle on the label is formed as an opening in the label. Thus, the label is only a plate punched out of sheet material and to change the position of the label, all that has to be done is to put a ball point pen or a like pointed instrument into the opening. The likelihood of incorrect operation is essentially eliminated, since the portion of the plate or label within the guide grooves, is nearly completely protected from undesired touching.

Another advantage of the invention is that the handle may be formed as a stop element. The handle may be, for example, a cut-in, bent-up lug on the label, which is readily able to be gripped and moved by fingernail without having to use any tool. This handle is used as a stop and, for this reason, it is not possible for the label to be touched directly by the base of the guide groove, something which in some cases would likely result in increased friction and other trouble on moving a label element.

In this case the two edges of the tab-strip body in which the guide grooves are placed, are best made as stop counter-elements. Though the handles in the form of stop elements can be gripped without a tool because they are in line with the edges of the strip body, they do not in each of their stop positions result in sticking in position or undesired movement out of position.

The base plate of the label element is best made smooth throughout, which is advantageous particularly where an opening is used as a handle, since any paper strip pushed under the label element is not scratched or otherwise damaged by engagement with the tools used for changing the position. In a further feature of the invention, it may be advantageous as well if a recess is made in the base plate of the label element. It is possible, for example, for the recess to be under the opening in order to insure that the tool has access to the label and, if necessary, to facilitate removal of the label.

It is furthermore preferred that the sides of this recess be in the form of stop counter-elements, if for example a cut-in and bent round lug comes up against the recess. The advantage of this is that, after putting the label element together, there is no chance of the latter slipping out of its grooves before the label element has been put in the tab-strip body.

In a form of the invention, the stop counter-elements are formed as catch elements for operation with the handle. It is advantageous if a protruding part is formed in a label of thermoplastic material and which, in its two positions, connects with a hole in the base plate and, thus, forms a catch which keeps the label in position.

Furthermore, openings may be provided in the base-face of the guide groove of the body which is turned away from the filing material through which the labels can be removed. In this case projections are present which clearly extend beyond the edge of the tab-strip, and the stop noted earlier insures that the label is not able to come out of the strip, and a catch is at the same time able to insure that when the label is touched, it is able to be pushed back into the base plate.

In a further embodiment of the invention, a catch projection is provided in the strip body and/or in the base plate and in the other of these two parts an element of the opposite form is provided. It is, for example, possible to have catch projections formed in the tab-strip body between the separate positions of the label element. This may be accomplished, for example, by hot-forming of the right thermoplastic material so that a label element is at all times kept in place between the two catch projections. The catch projections make possible a change in position upon application of an increased force, but insures against any undesired slipping. In like manner it is possible to have a strip running in the direction of extrusion in the base plate as well, which can be made by cutting off extruded rod material. This strip or rail is able to be pushed into and held in depressions formed in the tab-strip body.

It is also possible to make this catch as a guide for the label. It is, for example, possible for the label to be guided between two catch projections and, when this is done the depth of the guide grooves positioned on both sides of the tab-strip body may be so increased that any falling out of the label is prevented and, in some cases, it is possible to do away completely with the base plate.

It is possible for the label to have an opaque covering toward the outer side of the tab-strip which has a recess above the line of movement of the handle for changing the position of the label in order to insure that the label is not seen in its resting position. If, for example, the label is in the form of a colored plate, then its color and the marking used with it will only be seen when the label is in its labeling position.

In a further feature of the invention, it may be advantageous if the base plate itself is formed as a cover. In such case the base plate only need have a punched recess above the handle of the label and coloring above the resting position of the label.

It is generally possible for the tab-strip body to be made of opaque material, if above the labeling positions, it has openings for seeing the label, or if the labeling position of the label is in part outside of the tab-strip body. In a further form of the invention it is particularly advantageous if the tab-strip body is formed of transparent material, which makes it easier to see the labels. Though it is possible for the labels to have the tab-strip body extending around them in their labeling position in which case any touching or undesired changing in position of the labels would be prevented.

Lastly, it is possible for the label elements to be made of different widths. A label element with a greater width has the advantage of being readily seen at greater as well as at shorter distances. It may also be used as a general label or heading in addition to the normal width label elements.

BRIEF DESCRIPTION OF THE DRAWING

Details of the invention will now be given referring to the drawings of the application which are orthogonal projections.

DESCRIPTION OF THE PREFERRED EMBODIMENTS

Figure 1:
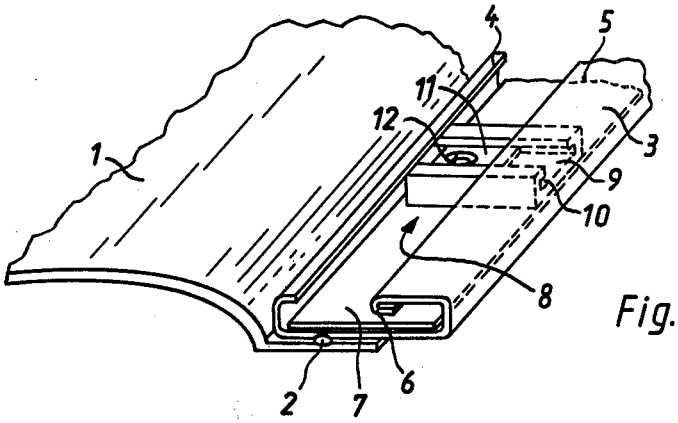
FIG. 1 is the view of part of a tab-strip constructed in accordance with the principles of the invention placed on a transparent file docket.

FIG. 1 is a view of the top edge 1 of a transparent file docket (not seen). On this top edge a tab-strip body 3 is joined by a weld seam 2 to the docket. The body 3 has a back guide groove 4 and a front guide groove 5. The tab-strip body 3 is preferably made of a colorless transparent thermoplastic material and is bent into the form shown in the drawing. Alternatively, the tab-strip body and the weld seam may be hot-formed in the same process, for example by common extrusion.

The front guide groove 5 has an edge 6 which is bent over inwardly as shown in FIG. 1. A paper strip 7 is inserted in the tab-strip body 3. A label element 8 is positioned in the body above the paper strip 7. Label element 8 includes a base plate 9 on the top face of which an edge has been formed having a groove 10 for receiving a label 11.

The bent over edge 6 of the front guide groove 5 forms a smooth guide-way for receiving the label element 8. When the label element 8 has been inserted, the edge 6 presses the label element 8 onto the paper strip 7 so that slipping of the element is prevented. The label 11 is inserted into the two grooves 10 with a light gripping fit so that it is able to be moved from the position shown in FIG. 1 to a position beneath edge 6. The label 11 has a punched hole 12 which acts as a handle.

Figure 2:
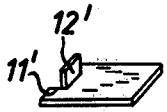
FIGS. 2 and 3 are views of two embodiments of labels constructed in accordance with the principles of the invention.

Referring to FIG. 2, a label 11′ is shown, which instead of a punched handle 12, has a bent-up lug 12′ as a handle. The lug 12′ not only acts as a handle, but also functions as a stop which abuts the edge of the back guide groove 4 or the edge 6 of the front guide groove 5. If the front guide groove 5 is of the right size, it may have an opening (not shown) near the lower face of the groove opposite to the label 11′ so that the label 11′ may be removed from the tab-strip body 3. Furthermore, the bent-up lug 12′ may be used as a handle which can easily be gripped by a fingernail without the need for a tool.

Figure 3:
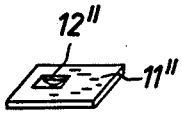

In FIG. 3 a label 11″ is shown which, as a handle, has a downwardly curved depression 12″. The vertical depth of this depression is best made larger than the vertical size of the grooves 10 so when the label 11″ is inserted in the base plate 9, the label is forced against the sides of the grooves 10 and is, thereby, held in place. Holes or recesses (not shown) may be formed in the base plate 9 in the end positions of the label 11″ under the depression 12″ to act as a catch for keeping the label 11″ in place.

Figure 4:
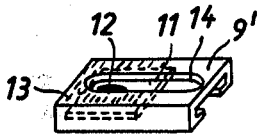
FIG. 4 is a view of another embodiment of label element constructed in accordance with the principles of the invention.

FIG. 4 is a view of a variation of base plate 9′ which is formed of a colorless transparent material and which has an opaque zone 13, which lies over the label 11 in its resting position so as to at least partially obscure the label. A slot 14 is punched in the base plate 9′ for access to the label 11.

While an account of the invention has been given for one particular use, it will be appreciated that the present invention may be used in other temporary labeling functions, for example for wall charts and all other office uses.

What is claimed is:

1. A tab-strip for filing material comprising a strip body adapted to be attached to the filing material, said strip body having elongate front and second edges, said front edge including a guide groove facing the rest of the tab-strip, at least one label element, said strip body having means for directly temporarily fixing said label element to said strip body independently of any other label elements if such label elements are present, said label element being generally rectangular in shape and having a length such that it fits loosely between said elongate front and second edges, and having a diagonal length greater than the distance between said edges, said label element also having a height which forms a tight fit in said groove, guide means on said label element, and at least one label positionable in said guide means, said label having a handle accessible through said label element, said label being movable by said handle between one of at least two positions in said label element.

2. The tab-strip of claim 1, wherein said second elongate edge also includes a guide groove.

3. The tab-strip of claim 1, wherein said second elongate edge comprises a stop edge.

4. The tab-strip of claim 1, wherein at least said guide groove comprises spring means.

5. The tab-strip of claim 1, including a slip sheet between said strip body and said label element.

6. The tab-strip of claim 5, wherein said slip sheet comprises a paper strip.

7. The tab-strip of claim 1, wherein said label element comprises a base plate which is movable relative to said strip body, and wherein said guide means comprises grooves which face each other on the sides of said base plate in the direction of movement of the base plate, said grooves grippingly receiving said label, but allowing movement thereof in said label element.

8. The tab-strip of claim 7, including at least two stop means for limiting the movement of said label.

9. The tab-strip of claim 8, wherein said stop means comprise edges of said label and at least a portion of said means for fixing said label element to said strip body.

10. The tab-strip of claim 8, wherein said stop means includes said handle.

11. The tab-strip of claim 2, including stop means for limiting movement of said label both of said guide grooves defining at least a portion of said stop means.

12. The tab-strip of claim 1, wherein said handle is defined by an opening in said label.

13. The tab-strip of claim 7, including a recess in said base plate.

14. The tab-strip of claim 7, including a recess in said base plate, said recess defining at least a part of stop means for the label.

15. The tab-strip of claim 14, wherein said recess receives said handle.

16. The tab-strip of claim 1, including openings in said guide groove.

17. The tab-strip of claim 7, comprising at least one projection on one of said base plate and said strip body, and at least one depression on the other of said base plate and said strip body cooperating with said projection.

18. The tab-strip of claim 7, including an opaque cover for said label facing outwardly of the tab-strip, and a recess in said cover overlying said handle.

19. The tab-strip of claim 18, wherein said base plate comprises said cover.

20. The tab-strip of claim 1, wherein said strip body is substantially transparent.

21. The tab-strip of claim 1, comprising at least two of said label elements, both of said label elements having differing widths.

22. The tab-strip of claim 1 wherein said label element is movably attached to said strip body.

* * * * *